United States Patent [19]

Lansdown

[11] Patent Number: 4,544,017

[45] Date of Patent: Oct. 1, 1985

[54] USE OF A HYDRAULIC SQUEEZE FILM TO LUBRICATE THE STRAND IN CONTINUOUS CASTING

[75] Inventor: Anthony R. Lansdown, Swansea, England

[73] Assignee: The University College of Swansea, Swansea, England

[21] Appl. No.: 557,282

[22] PCT Filed: Mar. 17, 1983

[86] PCT No.: PCT/GB83/00079

§ 371 Date: Nov. 18, 1983

§ 102(e) Date: Nov. 18, 1983

[87] PCT Pub. No.: WO83/03214

PCT Pub. Date: Sep. 29, 1983

[30] Foreign Application Priority Data

Mar. 18, 1982 [GB] United Kingdom ..... 8207988

[51] Int. Cl.[4] ..... B22D 11/04

[52] U.S. Cl. ..... 164/472; 164/478

[58] Field of Search ..... 164/478, 416, 260, 71.1, 164/466, 502, 147.1, 472

[56] References Cited

FOREIGN PATENT DOCUMENTS 1208333 10/1970 United Kingdom ..... 164/416

*Primary Examiner*—Kuang Y. Lin

*Attorney, Agent, or Firm*—Michael J. Striker

[57] ABSTRACT

A method of continuously casting a strand, having of the steps of providing a cooled mould having a wall defining a passage having one end and another end, feeding molten material into the one end in a direction towards the other end, lubricating the passage with a film of lubricant interposed between the mould wall and the molten material, the lubricant film having a thickness, withdrawing an at least surface-hardened strand from the other end of the passage, and subjecting at least one region of the wall of the mould to oscillations transverse to the direction of movement of the molten material, said oscillations having an amplitude that is less than the lubricant film thickness, and also having a frequency that is less than that which will promote cavitation in the lubricant film, the amplitude and the frequency of the oscillations generating a pressure increase in the lubricant by way of a squeeze film phenomenon.

9 Claims, 3 Drawing Figures

USE OF A HYDRAULIC SQUEEZE FILM TO LUBRICATE THE STRAND IN CONTINUOUS CASTING

TECHNICAL FIELD

This invention relates to an improved method of continuous casting, improved continuous casting apparatus and to material cast by the method or on the apparatus. In the continuous casting of metals, the molten metal passes from a container or tundish into a cooled mould in which the skin of the metal solidifies sufficiently to support the newly formed metal strand. Further solidification takes place as this strand is withdrawn from the bottom of the mould. The continuous casting apparatus may be of either vertical or horizontal type.

DISCUSSION OF PRIOR ART

In the case of steel the mould is usually made of copper and is water cooled. There is a strong tendency for the solidifying surface of the hot steel to stick to the cold surface of the mould. Such sticking is highly undesirable as it can tear the thin solidified skin and result in the uncontrolled loss of molten metal. Even if the skin does not rupture, this sticking can cause irregular cooling. This can initiate cracking and a poor surface that is expensive to rectify and in the worst excess can cause the cast metal to be scrapped. If there is an uncontrolled break out of molten metal this can also lead to the scrapping of the mould.

To reduce sticking and to permit the smooth passage of the steel strand through the mould various lubricants are used ranging from vegetable and mineral oils (especially rape seed oil) to various metal powders which are molten at the temperature of the surface of the steel, but solid at the cooled surface of the mould.

The mechanism by which mould powders lubricate has not been properly established. The geometry of the nozzle or mould is such that the mould lubricant used is unlikely to be subjected to any significant hydrodynamic pressure. The geometry is determined by factors other than the lubrication requirements, and it would be difficult, if not impossible, to modify the geometry in order to improve the lubrication using known lubricants.

It is known to divide a mould longitudinally into parts and to vibrate these parts one relative to the other(s) transversely of the direction of movement of the cast strand through the mould.

U.K. Pat. No. 967,699 discloses the use of lateral vibration of mould sections in conjunction with axial vibration, for the purpose of propagating the strand through the mould by means of the forward axial strokes, while eliminating or reducing contact and drag during the backward axial strokes. This prior disclosure specifies a frequency range of 5,000 to 50,000 cycles per minute (83 Hz to 833 Hz) and suggests that the higher the frequency, the better will be the result obtained.

U.K. Pat. No. 1,208,333 discloses the use of lateral oscillation of the walls of the mould in continuous casting, in synchronisation with axial oscillation, for the purpose of propagating the strand through the mould by means of the forward axial strokes while eliminating contact and drag during the reverse strokes. This prior proposal employs frequencies in the range 20 to 50 strokes per minute (0.3 to 0.8 Hz) and for the lateral oscillations, amplitudes preferably of the order of up to 10 millimeters.

U.K. Specification No. 570423 also proposed the use of a split mould with vibration means to move the mould parts towards and away from each other and relates to the use of a lubricant which will decompose to become soot-like solid particles at the casting temperature.

U.S. Pat. No. 3,626,510 discloses a hydraulic thrust bearing (e.g. for a gyroscope) in which a positive load supporting force is generated in an incompressible liquid layer filling a gap between relatively movable bearing surfaces, by oscillating one bearing surface normal to the gap so as to produce a beneficial increase in pressure in the lubricant film (the so-called squeeze film phenomenon).

It has now been found that the squeeze film phenomenon disclosed in U.S. Pat. No. 3,626,510 can be applied to the totally different art of continuous casting to improve the strength and stability of a lubricant film between a mould and a strand being cast through the mould, to reduce the risk of solid-solid contact therebetween.

BRIEF STATEMENT OF THE INVENTION

According to one aspect of the invention, a method of continuously casting a strand which comprises feeding molten material into one end of a passage defined by the wall(s) of a cooled mould and withdrawing an at least surface-hardened strand from the other end of the passage, the passage being lubricated by a film of lubricant interposed between the mould walls(s) and the material of the strand, and subjecting the wall(s) of the mould, at least in one region, to oscillations transverse to the direction of movement of the strand-forming material through the passage, is characterised in that the amplitude of the oscillations is less than the thickness of the lubricant film and the frequency of oscillations is less than that which will promote cavitation in the lubricant film, whereby a beneficial pressure increase is generated in the lubricant by means of the squeeze film phenomenon.

According to a further aspect of the invention, there is provided a continuous casting apparatus which comprises a mould having (a) wall(s) defining a passage therethrough, means to feed molten material into an inlet end of the passage, means to cool the wall(s) of the mould whereby at least the mould wall confronting surface(s) of the cast material solidify within the mould to ensure an at least partially solidified strand leaves an outlet end of the passage, means to line at least that end of the passage adjacent to the inlet end with a liquid film of lubricant, and means to subject said wall(s) of the mould to oscillations transverse to the direction of movement of cast material through the passage, which apparatus is characterised in that the amplitude of the oscillations is less than the thickness of said lubricant film and the frequency of oscillations is less than that which will promote cavitation in the lubricant film, whereby a beneficial pressure increase is generated in the lubricant by means of the squeeze film phenomenon.

Normally the amplitude of the oscillations would be less than 75% of the thickness of the lubricant film and amplitudes less than 50% are likely to be typical.

For most applications, a suitable frequency will lie within the range 0.5 Hz to 80 Hz and the corresponding amplitudes will be below 2 mm. The maximum frequency for a particular amplitude in a particular application is limited by the onset of cavitation, and may be approximately calculated theoretically. In the case of a lubricant film on a rectangular surface (i.e. one wall of a mould of polygonal cross-section) an equation of the general form $$\omega_{max}^2 = \frac{2P_o\left(\frac{1}{e} - 1\right)}{\pi^2 \rho W^2}$$

applies, where $\omega_{max}$=the maximum frequency in Hz $P_o$=the absolute pressure in the lubricated zone in $N/m^2$ in the absence of vibration e=the ratio of vibration amplitude to mean lubricant film thickness $\rho$=the density of lubricant in $kg/m^3$ W=the axial length of the mould in nominal contact with the strand in m.

It is usually desirable to operate at a frequency not less than 80% of $\omega_{max}$.

On the basis of the general equation given above, the beneficial pressure generated in the lubricant film is given approximately by an equation of the general form $$P_{max} = \frac{2}{3} P_o\left(\frac{1}{e} - 1\right)\left[\frac{1}{\sqrt{1 - e^2}} - 1\right]$$

The frequencies advocated in U.K.-A-967,699 lie above those expected to be applied in the method of the present invention and would produce cavitation. Thus the benefits of the squeeze film phenomenon could not even fortuitously have occurred.

The amplitudes proposed in U.K.-A-1,208,333 are significantly greater than the mean lubricant film thickness, and cannot therefore generate the beneficial effect of the squeeze film phenomenon, since if the ratio of vibration amplitude to mean lubricant film thickness is greater than unity, cavitation will occur at any frequency.

In addition to the beneficial pressure increase in the lubricant film which results from the method of the invention, the use of the method of the invention makes possible the removal of heat from the solidifying stream in a more uniform manner and thereby reduces the stresses set up in the metal skin.

Where the mould is a liquid coolant-filled hollow body, the oscillations can be produced via the coolant. The optimum frequency and amplitude of the applied oscillation will depend on many factors, including the nature of the mould lubricant, the metal being cast, the geometry and dimensions of the mould, the viscosity, density and surface tension of the solidifying metal and the speed of movement of the metal strand through the passage.

The required oscillation can be generated by any suitable technique, including, but not limited to, the following:

(i) Generation of a pressure pulsing in the cooling water supplied to the mould.

(ii) Use of one or more piezoelectric devices attached to the mould surface which is to be oscillated.

(iii) Mechanical oscillation or vibration by means of an eccentric, cam, or other suitable mechanical device.

BRIEF DESCRIPTION OF DRAWINGS

The invention will now be further explained, by way of example, with reference to the accompanying drawings, in which.

DESCRIPTION OF PREFERRED EMBODIMENTS

Figure 1:
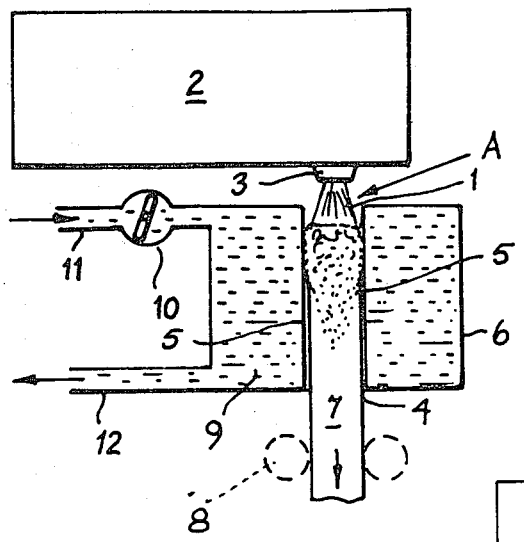
FIG. 1 is a schematic representation of the use of pressure pulse in the liquid coolant (water in the illustratd case) fed to the interior of a hollow mould having relatively thin (and thus flexible) passage-defining walls.

FIG. 1 shows a vertical continuous casting plant in which molten material 1 to be cast is fed from a tundish 2 via a nozzle 3 into the open upper end of a passage 4 defined by the water-cooled walls 5 of a mould 6.

The material hardens into a strand 7 within the passage and exit downwardly possibly assisted by a withdrawing means 8.

Figure 2:
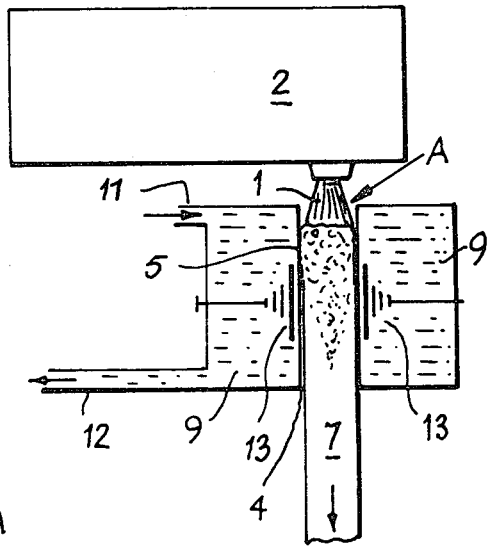
FIG. 2 illustrates the use of (a) piezoelectric device(s) to generate the pressure pulses.
Figure 3:
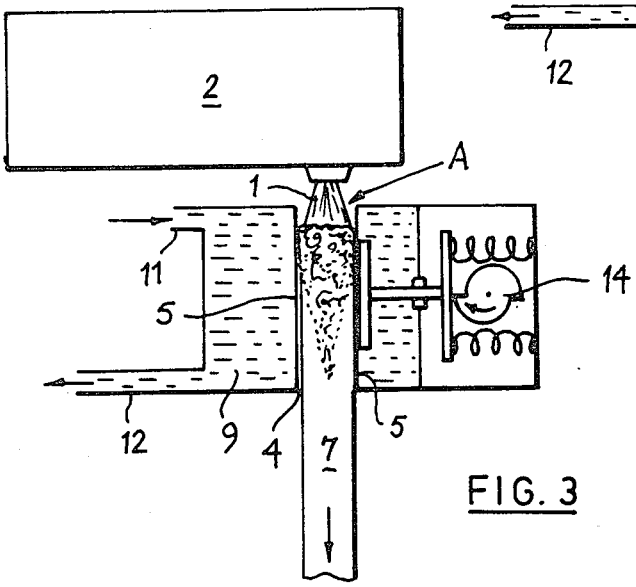
FIG. 3 illustrates the use of a mechanical device to produce the required oscillations in the lubricant film.

Lubricant is introduced at A and flows with the material 1 into the passage 4 to line the walls 5 with a liquid film thereof. Pressure in the lubricant film is increased by vibrating the walls 5 transversely of the direction of movement of the material 1 through the passage 4 at an amplitude less than the thickness of the lubricant film and at a frequency just below that which will induce cavitation in the liquid film closest to the walls 5. These vibrations are obtained by pulsing the coolant 9 with a device 10. 11 is the coolant (e.g. water) inlet and 12 the coolant outlet. FIGS. 2 and 3 are similar to FIG. 1 and the same reference numerals have been used therein to designate similar components.

In FIG. 2 the required increase in lubricant pressure in the film is produced by piezoelectric devices 13 attached to the inside surfaces of the walls 5.

In FIG. 3 a mechanical vibrator 14 (e.g. a rotating cam or eccentric) produces the required vibrations.

Where a mould 6 of polygonal cross-section is used, it would normally be desirable to subject each wall to vibrations (since the small amplitudes involved will not normally be transmitted reliably through the molten core of the strand 7).

It is important that the pressure generated in the lubricant film is not allowed to escape at the ends of the film, but in practice the length to thickness ratio of the film is so great that there is negligible loss of pressure from this effect except at the extreme ends of the film where conditions are less critical.

The method of introducing the lubricant into the mould/strand interface is not limited and conventional methods can be used. One suitable technique is to feed the liquid or fusible solid lubricant onto the molten metal surface in the mould at or near its meniscus.

For convenience, the lubricant film has not been shown in any of the Figures, but in each case it will line the passage defined by the mould.

The strand can, of course, be of any desired cross-section and of any continuously castable material (metallic or otherwise).

EXAMPLE I

In a first example of the application of the invention, aluminium is continuously cast in a rectangular mould with an axial length of 0.3 m using an organic oil as the lubricant. The maximum relative pressure exerted by the skin of the solidifying aluminium on the mould surface due to the column of liquid aluminium will be approximately 4200 N/m$^2$. Taking the lubricant density as 800 kg/m$^3$ and the ratio of vibration amplitude to mean lubricant film thickness as 0.2, then $$P_o = \text{mean applied pressure plus atmospheric pressure} = 2100 + 101300 = 103400 \text{ N/m}^2$$

and $$\omega_{max}^2 = \frac{2 \times 1.034 \times 10^5 \left(\frac{1}{0.2} - 1\right)}{\pi^2 \times 800 \times 0.3^2}$$

so $$\omega_{max} = 34.1 \text{ Hz}$$

$$P_{max} = \frac{2}{3} \times 103400 \times \left(\frac{1}{0.2} - 1\right)\left[\frac{1}{\sqrt{1 - 0.2^2}} - 1\right]$$

$$= 5685 \text{ N/m}^2$$

Thus the maximum pressure generated in the lubricant film is higher than the pressure imposed by the cooling aluminium on the mould surface. Thus a value of e less than 0.2 could be chosen without losing the benefit afforded by the invention.

Where the amplitude of the vibration is 0.2 times the mean lubricant film thickness, vibration amplitudes of the order of 0.1 mm would be employed.

EXAMPLE II

In a second example of the application of the invention, steel is continuously cast in a rectangular mould with an axial length of 0.5 m using a glass or molten mould powder as the lubricant. The maximum relative pressure exerted by the skin of the solidifying steel on the mould surface due to the column of liquid steel will be approximately $2.074 \times 10^4$ N/m$^2$. Taking the lubricant density as $2 \times 10^3$ kg/m$^3$, and the ratio of vibration amplitude to mean lubricant film thickness as 0.5, then $$P_o = 1.037 \times 10^4 + 10.13 \times 10^4 = 11.167 \times 10^4 \text{ N/m}^2$$

and $$\omega_{max}^2 = \frac{2 \times 11.167 \times 10^4 \left(\frac{1}{0.5} - 1\right)}{\pi^2 \times 2 \times 10^3 \times 0.5^2} = 45.26$$

so $$\omega_{max} = 6.7 \text{ Hz}$$

$$P_{max} = \frac{2}{3} \times 11.167 \times 10^4 \left(\frac{1}{0.5} - 1\right)\left[\frac{1}{\sqrt{1 - 0.5^2}} - 1\right]$$

$$= 1.1516 \times 10^4 \text{ N/m}^2.$$

Thus the maximum pressure generated in the lubricant film will in this case be a high proportion of the pressure imposed by the cooling steel on the mould surface.

In this example the amplitude of the vibration is 0.5 times the mean lubricant film thickness and will be of the order of 1 mm. The pressure generated by the lubricant film can be increased by raising e to about 0.7.

The principal benefits of the application of this invention may be identified as improvements to the apparatus in that due to the fewer interruptions to casting from break-outs there will be greater equipment availability and less interference with production. There will also be a reduction in mould cost due to the scrapping of fewer moulds from break-outs and the developments of cracks and imperfections on the surface due to the solidification of the metal in contact with the mould.

In addition, it is anticipated that in some circumstances the withdrawal technique of the strand from the mould can be modified particularly in those cases where a process of negative strip is applied, so as to reduce the applied stresses. Alternatively, it may be possible to increase the speed of a casting by removing energy faster from the solidifying metal. It is emphasised that this potential benefit will be directly related to the geometry of the particular design of continuous casting plant in question and the metal concerned.

In addition to the benefits that are obtainable by the use of this invention to the apparatus there are also benefits to the product by the use of the improved casting method. The improved surface will increase the potential sold yield as there should be a reduction in the amount of surface preparation that is necessary on the cast material before further processing, e.g. scalping or scarfing. The improvement in heat transfer should reduce the potential corner and panel cracking, again improving the proportion of cast strands that can be sold as first-class material. The improvement in the surface is particularly important where flat products are to be rolled, as the condition of the cast surface will be directly related to the finished surface of flat rolled products.

I claim:

1. A method of continuously casting a strand, comprising the steps of: providing a cooled mould having a wall defining a passage having one end and another end; feeding molten material into said one end in a direction toward said other end; lubricating said passage by interposing film of lubricant between said mould wall and said molten material, said lubricant film having a thickness; withdrawing an at least surface-hardened strand from said other end of said passage; and subjecting at least one region of said wall of said mould to oscillations transverse to the direction of movement of said molten material, said oscillations having an amplitude less than said lubricant film thickness, and also having a frequency that is less than that which will promote cavitation in said lubricant film, said amplitude and said frequency of said oscillations generating a pressure increase in said lubricant by way of a squeeze film phenomenon.

2. A method as defined in claim 1, wherein said subjecting step includes subjecting said wall to oscillations having an amplitude that is less than 75% of said thickness of said lubricant film.

3. A method as defined in claim 2, wherein said subjecting step includes subjecting said wall to oscillations having an amplitude that is less than 50% of said thickness of said lubricant film.

4. A method as defined in claim 3, wherein said subjecting step includes subjecting said wall to oscillations having a frequency, that is less than 80 Hz.

5. A method as defined in claim 1, wherein said subjecting step includes subjecting said walls to oscillations having a frequency that is not greater than $$\sqrt{\frac{2P_o\left(\frac{1}{e}-1\right)}{\pi^2\rho W^2}}\ HZ$$

where $P_o$=the absolute pressure in the lubricant in $N/m^2$ in the absence of vibration e=the ratio of vibration amplitude to mean lubricant film thickness $\rho$=the density of lubricant in $kg/m^3$, and W=the axial length of the mould wall in nominal contact with the strand in m.

6. A method as defined in claim 5, wherein said subjecting step includes subjecting said wall to a frequency of oscillations that is not less than 80% of the frequency calculated from the expression in claim 5.

7. A method as defined in claim 6, wherein said subjecting step includes subjecting said mould wall to oscillations that are induced by pressure pulses applied to a liquid coolant flowing in said mould adjacent to said passage.

8. A method as defined in claim 6, wherein said subjecting step includes subjecting said mould wall to oscillations that are induced by piezoelectric devices attached to said wall.

9. A method as defined in claim 6, wherein said subjecting step includes subjecting said mould wall to oscillations that are induced by a mechanical vibration device attached to said wall.

* * * * *